United States Patent [19]

Mulock-Bentley

[11] Patent Number: 4,657,072

[45] Date of Patent: Apr. 14, 1987

[54] PANEL-TYPE COUNTER-FLOW HEAT EXCHANGER WITH FIN STRUCTURES FORMED FROM SHEET METAL

[75] Inventor: Desmond Mulock-Bentley, Transvaal, South Africa

[73] Assignee: D. Mulock-Bentley & Associates (Proprietary) Limited, South Africa

[21] Appl. No.: 745,203

[22] Filed: Jun. 17, 1985

[30] Foreign Application Priority Data

Jun. 20, 1984 [ZA] South Africa ..... 84/4710

[51] Int. Cl.[4] ..... F28D 1/02

[52] U.S. Cl. ..... 165/153; 165/122; 165/165; 165/173; 165/900

[58] Field of Search ..... 165/152, 153, 173, 166, 165/165, 122, 900

[56] References Cited

U.S. PATENT DOCUMENTS

| | | | |
|---|---|---|---|
| 1,013,973 | 1/1912 | Trisler | 165/153 |
| 1,215,793 | 2/1917 | Gabrielson | 165/152 |
| 1,421,546 | 7/1922 | Parkin | 165/152 |
| 1,899,080 | 10/1931 | Dalgliesh | 165/153 |
| 1,906,077 | 4/1933 | Modine | 165/152 |
| 1,950,500 | 4/1932 | Loprich et al. | 165/153 |
| 2,252,211 | 8/1941 | Seemiller | 165/152 |
| 2,360,123 | 9/1942 | Gerstung et al. | 165/153 |
| 4,310,960 | 1/1982 | Parker | 165/166 |
| 4,332,291 | 6/1982 | Mulock-Bentley | 165/76 |
| 4,488,593 | 12/1984 | Mulock-Bentley | 165/151 |

FOREIGN PATENT DOCUMENTS 1258111 7/1961 France .

*Primary Examiner*—William R. Cline
*Assistant Examiner*—Richard Cole
*Attorney, Agent, or Firm*—Stevens, Davis, Miller & Mosher

[57] ABSTRACT

A heat exchanger capable of use as a counter-flow heat exchanger comprises a series of conduits for a first fluid, the conduits being arranged in panels that are spaced apart. The intervening spaces are traversed by a second fluid, and surface-extending elements are located in such spaces, each surface-extending element comprising a sheet from which portions have been pressed out to define a number of knuckles that are located in heat-transmitting contact with a conduit panel on one side of the space. At least some of the knuckles may be secured to the conduit panel.

4 Claims, 6 Drawing Figures

PANEL-TYPE COUNTER-FLOW HEAT EXCHANGER WITH FIN STRUCTURES FORMED FROM SHEET METAL

FIELD OF THE INVENTION

This invention relates to a heat exchanger of the type having a series of conduits traversed by a first fluid, separated by a space in which surface-extending members are located and which space is traversed by a second fluid to which heat from the first fluid is transmitted. The surface-extending members are commonly fins.

BACKGROUND OF THE INVENTION

The conduits in such heat exchangers may be of many shapes but in certain applications, such as for dry-type cooling towers, they may conveniently be panels formed from two layers of sheet material, bends in the sheets forming the cavities in which the first fluid is accommodated. With this type of construction the surfaces of the conduits, except where seams exist separating adjacent conduits in the panel, can be generally planar, although it is often advantageous to introduce local corrugations in the conduit surfaces, extending at right angles to the direction of flow in the conduits, in order to extend the surface area exposed to the fluids, to induce turbulent fluid flow, and to provide seating formations for the fins. In such cases the fins may suitably be strips of metal from which portions are removed or pressed out of their original planes. Heat exchangers of this type can be highly efficient and it is possible to manufacture them economically. They are however expensive to assemble because of the laborious task of inserting the numerous fin strips in place between the conduit panels. Moreover, since the direction of the flow of the fluid traversing the fins is necessarily at right angles to the direction of flow of the fluid in the conduits (i.e. a cross-flow arrangement), the inherent capability of the heat exchanger is somewhat removed from the ideal.

The ideal situation is a counter-flow arrangement, in which the directions of flow of the two fluids are opposite to each other.

It is an object of the invention to provide a heat exchanger having adequate provision for the extension of the conduit surfaces, but in which some of the disadvantages of known heat exchangers, particularly those of the type mentioned above, are mitigated or overcome.

SUMMARY OF THE INVENTION

According to the invention a heat exchanger comprises a series of conduits for a first fluid, the conduits being arranged in panels that are spaced apart to define spaces adapted to be traversed by a second fluid, and surface-extending elements located in such spaces, each surface-extending element comprising a sheet from which portions have been pressed out to define a number of knuckles that are located in heat-transmitting contact with a conduit panel on one side of the space.

There may be one or more conduits in each panel. Preferably the sheet of the surface-extending elements is generally planar, and the residual portion thereof (i.e. excluding the pressed-out portions) is generally parallel to the general plane of the surfaces of the conduit panels. Local and preferably gentle corrugations may however be provided in this residual portion.

Another aspect of the invention provides for use in a heat exchanger that includes a series of conduit panels, a surface-extending element comprising a sheet from which portions have been pressed out to provide a series of knuckles adapted to make heat-transmitting contact with the conduit panel.

The pressed-out portions of the sheet are preferably generally V-shaped, with the knuckles at their apices.

A preferred manner of secural of the surface-extending elements to the conduits comprises welding the knuckles or some of them to the surface of the conduits and hot-dipping the combined conduit-and-fin structure in a galvanising bath so that galvanising material fills the crevices in the vicinity of the knuckles and solidifies in due course, to form an efficient thermal bond between the fluid conduits and the fin structure.

One of the advantages of the invention is that it enables a true counter-flow heat exchanger to be provided, comprising panel-type conduits as described earlier with an extended surface area to be traversed by the second fluid.

A further advantage is that the laborious task of inserting individual fins or strips of composite fins into the spaces between two juxtaposed conduit panels is avoided. A sub-assembly can be formed of a series of panel-type conduits, each provided with a surface-extending element secured on both sides of it. This integral sub-assembly is introduced into the heat exchanger frame. Each such composite conduit-and-fin structure may be spaced apart from those next to it, in order to maximise the surface area available to be traversed by the fluid in the spaces between the conduits. This version is suitable where low pressures are present in the conduits. Alternatively, each such sub-assembly may make contact, along the outer surface of each of the two surface-extending elements, with the corresponding surfaces of the surface-extending elements secured to the adjacent sub-assembly. This version is useful when high pressure is present in the conduits, the mechanical contact between the adjacent surface-extending elements serving to prevent bulging of the conduits in the panels and so reducing the possibility of leakage or rupture of the conduits.

Each panel element and its attached surface-extending elements may be a complete unit with top and bottom header tubes, capable of being withdrawn from the heat exchanger for inspection or repair.

BRIEF DESCRIPTION OF THE DRAWINGS

FIG. 6 is a perspective view of a cross-flow heat exchanger incorporating surface-extending members of the invention.

DESCRIPTION OF PREFERRED EMBODIMENTS

Figure 1:
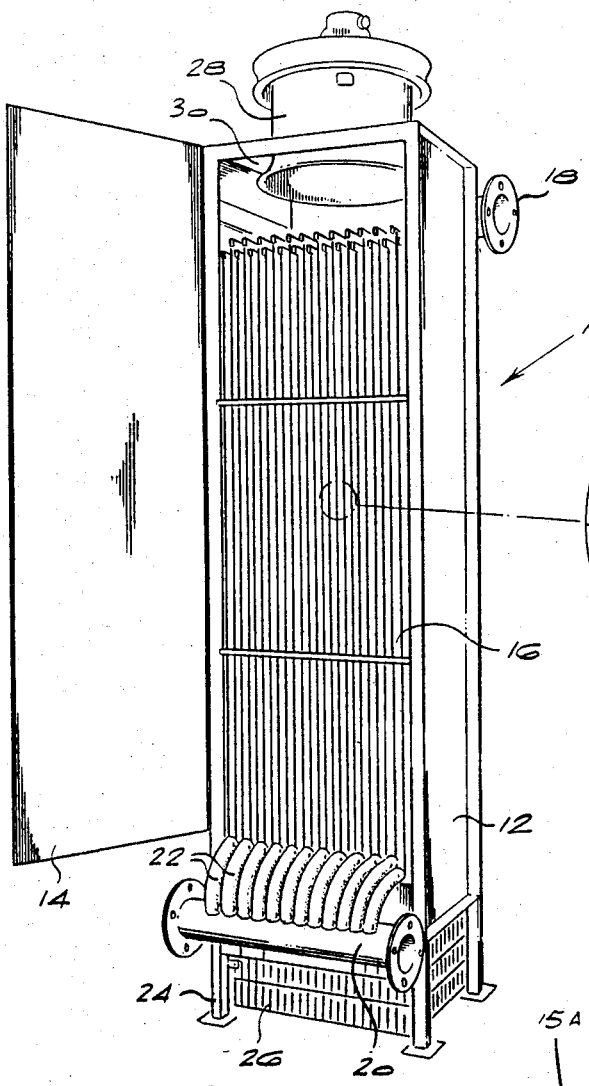
FIG. 1 is a perspective view of a counter-flow heat exchanger of the invention suitable for use in a cooling tower, shown in an open condition for easy viewing of its interior components.
Figure 3:
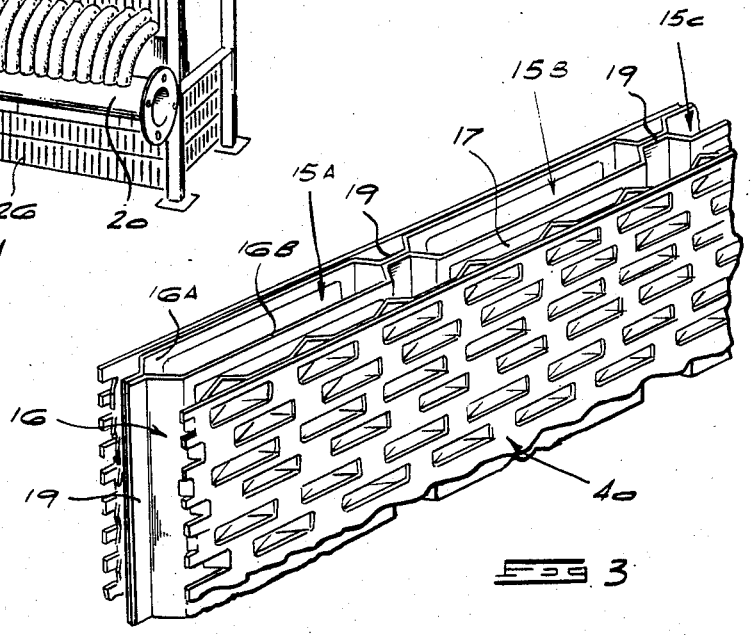
FIG. 3 is a fragmentary perspective view of a sub-assembly used in the heat exchanger of FIGS. 1 and 2.

In FIG. 1 a heat exchanger 10 comprises a housing 12 in the form of a cabinet with a hinged door 14 that is seen open. The remaining three vertical sides of the cabinet form, with the door, an airtight chamber within which is located a series of conduit panels 16 of a known type to form a heat transfer structure for a cooling tower or other similar application. These conduit panels 16 are each formed of two superimposed steel sheets 16A, 16B (FIG. 3) which have bends in the vertical plane to provide a series of vertically extending conduits 15A, 15B, 15C, etc. through each of which a fluid may flow. Local corrugations 17 extend horizontally in the surfaces of the conduit panels. Each conduit 15A, 15B, etc. in the panel is closed at its vertical edges by welded seams 19 (FIG. 3). There is an inlet manifold 18 for hot fluid at the upper end of the heat exchanger, with tubing (not visible) connecting the manifold to the various conduit panels 16. At the lower end there is an outlet manifold 20 to which each conduit panel 16 is connected by tubing 22.

The housing 12 is supported on legs 24 with a perforated screen 26 extending around the open base, which acts as an inlet for ambient air or other gas to be drawn upwards through the heat exchanger by a fan 28 located at the top of the housing and sealed in an aperture in the roof 30 of the housing.

Located in each space between two juxtaposed panels 16 is a pair of surface-extending elements 40 each in the form of a metal sheet from which individual V-shaped fin members 42 (FIG. 5) have been pressed out of the plane of the sheet. The pressed-out portions 42 are formed by shearing and deforming the metal in the pressed-out zones, but no metal is removed from the sheets. The apex of each V-shaped fin 42 forms a knuckle 44 in contact with the base of a corrugation 17 in the surface of a conduit panel 16. The structure is preferably such that each knuckle 44 is rounded both in the plane of the V and at right angles to that plane, and forms a relatively large zone of contact with the rounded bases of the corrugations 17 in the conduits.

Figure 4:
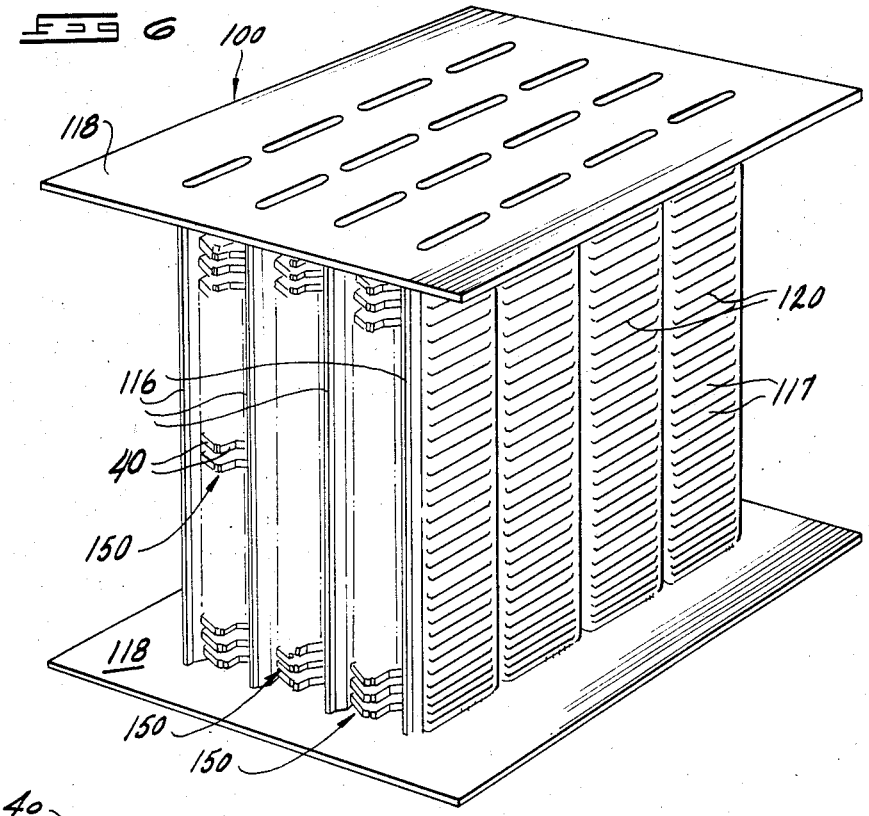
FIG. 4 is a fragmentary side elevation view of a surface-extending element as used in the structure of FIGS. 1 to 3.
Figure 4:
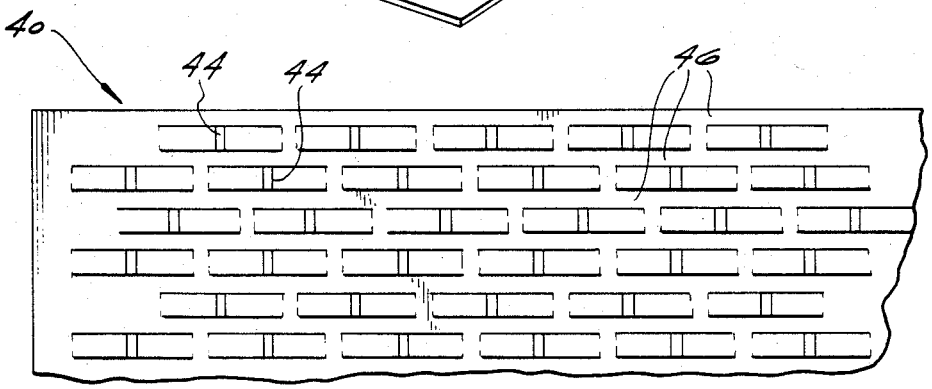
Figure 5:
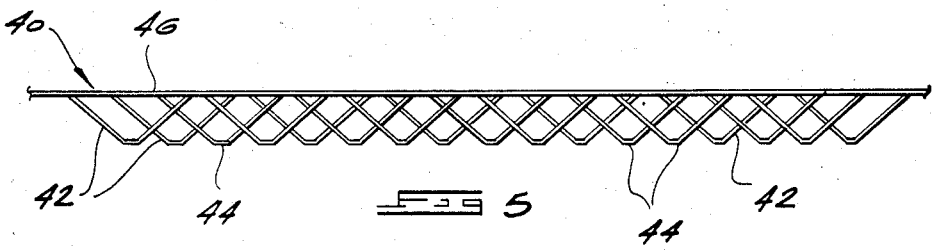
FIG. 5 is a plan view of a portion of the surface-extending element of FIG. 4, showing only two rows of V-shaped fin members.

As is clear from FIGS. 4 and 5, each sheet 40 contains a number of rows of fins 42 that are aligned in rows (i.e. left-to-right or right-to-left in FIGS. 4 and 5) but which are staggered relatively to each other along the length of the space traversed by air passing through the heat exchanger (i.e. in the direction normal to the paper as regards FIG. 5, and top-to-bottom or bottom-to-top of the paper in FIG. 4.). The extent of the staggering will be determined by known criteria in order to achieve the optimum performance of the heat exchanger by promoting controlled turbulence in the air flow.

The surface-extending element 40 seen in FIGS. 4 and 5 has, in the residual parts 46 of the sheet where no V-shaped fins 42 have been pressed out, a flat or planar configuration. However in some cases (not illustrated) it may be advantageous to provide gentle corrugations in the residual area 46, which contribute to the controlled turbulence of the gases which traverse them and correspondingly break down surface-layer formations and promote heat transfer.

As has been stated above, it is advantageous to weld a surface-extending element 40 to a conduit panel of the type described, welding occurring in the zone of the knuckles 44. Normally only a relatively small number of knuckles 44 need be welded to ensure a mechanically sound structure. However it is important that there be good heat-transmitting contact between the surface-extending elements 40 and the surface of the conduits 16, and for this reason it is advisable, if the structure is formed of steel, to galvanise it by hot dipping. This causes galvanising material to settle and solidify in the crevices and interstices around the knuckles 44 and the portions of the conduit panels with which they are in contact, so extending the area in which direct heat transmission occurs, and forming an efficient thermal bond.

It will be recalled that, while the V-shaped fins 42 are staggered in the direction of air flow (i.e. the direction normal to the paper containing FIG. 5) the fins 42 are aligned in the direction perpendicular thereto (i.e. from left to right in FIG. 4 or from right to left). The effect of staggering in the direction of air flow is of importance in generating controlled turbulence of the air flow.

The design details of the surface-extending elements, and consequently the pitch of the fins in the sheet, will be a matter of individual choice for particular applications, within the parameters of known requirements for optimised heat transfer.

Figure 2:
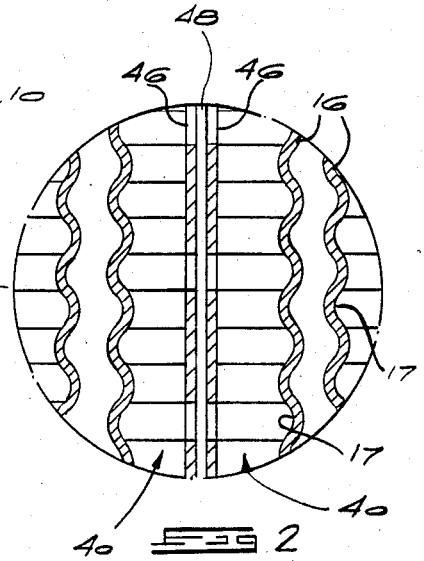
FIG. 2 is a view on an enlarged scale of the circled region in FIG. 1, shown sectioned.

FIG. 2 shows each planar portion 46 of the surface-extending elements 40 spaced apart by a gap 48 from the corresponding portion of the adjacent surface-extending element 40. This spacing has the effect of increasing the surface area of metal with which air or other fluids make contact as they pass through the spaces between the conduit panels. This construction is suitable if fluid in the conduits 15A, 15B, etc. is present at low pressure and no tendency exists to cause the surfaces of the conduit panels 16 to bulge. If however high pressure is likely to exist in the conduits, it may be advisable to provide the sub-assemblies 16,40 with the planar portions 46 of the surface-extending elements in back-to-back contact. In such cases no gaps 48 would exist. The close mechanical contact of the adjacent sub-assemblies 40,16,40 will then prevent distortion and rupture of the conduits 15A, 15B etc. A degree of heat transfer efficiency is then sacrificed as the exposed surface area of the metal in the spaces between the conduit panels is reduced.

Note in FIG. 2 that the corrugations 17 in the opposite surfaces of the conduit panels are staggered vertically. This provides a sinuous path for the fluid in the conduits without creating a throttling effect. The result is that controlled turbulence of the fluid in the conduit is promoted, and this enhances the efficiency of the heat exchange process.

FIG. 6 illustrates a second heat exchanger 100 comprising four conduit panels 116 which are welded to tube plates 118 above and below. Each panel 116 comprises four conduits 120 of elongate profile, this profile being seen in the upper tube plate 118. The surface of each panel is also provided with local corrugations 117 which stiffen the panel and extend the area to which the fluids traversing the heat exchanger are exposed, and also provide turbulent fluid flow. Located in the spaces between each pair of juxtaposed conduits 120 is, in each case, a pair of surface-extending elements 40 of the same type as those described in relation to FIGS. 1 to 5.

In the heat exchanger of FIG. 6 (the surrounding housing of which is not illustrated) the gas flow between the conduits takes place in the direction of the arrows 150. As the surfaces of the fins 42 serve to deflect the gas, controlled turbulence is created so that laminar flow is minimised and a fairly high efficiency is achieved. The fluid travelling through the conduits 120 is however travelling vertically (whether up or down through the heat exchanger as viewed in FIG. 6) in either single-pass, two-pass or four-pass flow, so that the resulting arrangement is a cross-flow heat exchanger.

In applications in which a counter-flow arrangement is required for reasons of heat transfer efficiency, the version of FIG. 1 will of course be used. In the version of FIG. 1, the fin configuration can be designed in such a fashion that very high efficiency may be achieved.

Note that, in the embodiments illustrated in the drawings, the residual portions 46 of the sheets forming the surface-extending elements 40 are, in the assembled heat exchanger, located in planes that are parallel to the planes defined by the overall surfaces (ignoring the local corrugations 17,117) of the conduit panels 16,116.

Preferred materials for forming the heat exchanger of the invention are steel (mild or stainless). Other materials for special applications include copper and aluminium and other materials with good heat-transmitting characteristics.

I claim:

1. A counterflow heat exchanger which comprises:

(a) a series of parallel, elongate conduits formed in conduit panels and adapted to be flowed through by a first fluid flowing in a first direction, the conduit panels being spaced apart to establish spaces therebetween which are adapted to be flowed through by a second fluid flowing in a second direction opposite to the first direction;

(b) the surfaces of the conduit panels being shaped to provide corrugations in the conduits which are transverse to the first and second direction, the corrugations promoting turbulent flow in the first fluid;

(c) pairs of surface-extending elements located in the spaces between the conduit panels;

(d) each surface extending element comprising a generally planar sheet of material from which V-shaped fins are pressed out of the plane of the sheet to leave slots in the sheet and remaining, generally planar portions of the sheet between the slots;

(e) the fins lying in planes transverse to the first and second directions with adjacent fins which are spaced apart from one another in the first or second direction being staggered with respect to one another in a direction transverse to the first and second directions;

(f) the surface extending elements in each pair being arranged with their remaining planar portions back-to-back and with their fins extending in opposite directions towards the conduit panels on opposite sides of the space in which said pair of surface extending elements is located; and (g) the apices of the fins presenting knuckles which are in heat-transmitting contact with the conduit panels between the corrugations thereof.

2. The counterflow heat exchanger of claim 1 in which some of the knuckles are secured by welds to the conduit panels, the other knuckles in heat-transmitting contact with the conduit panels being attached to the conduit panels by galvanizing material which provides a solid bond between the knuckles and the conduit panels.

3. The counterflow heat exchanger of claim 1 in which the V-shaped fins are arranged in parallel rows.

4. The counterflow heat exchanger of claim 1 in which the V-shaped fins have limbs which are substantially equal in length.

* * * * *